US006554334B2

(12) United States Patent
Rincon Uribe

(10) Patent No.: US 6,554,334 B2
(45) Date of Patent: Apr. 29, 2003

(54) APPARATUS AND METHOD FOR THE COLLECTION AND DISPOSAL OF WASTE MATERIALS

(76) Inventor: Victor Hernando Rincon Uribe, 450 Walker Valley Rd., Pine Bush, NY (US) 12566

( * ) Notice: Subject to any disclaimer, the term of this patent is extended or adjusted under 35 U.S.C. 154(b) by 0 days.

(21) Appl. No.: 09/902,426

(22) Filed: Jul. 11, 2001

(65) Prior Publication Data

US 2003/0011203 A1 Jan. 16, 2003

(51) Int. Cl.[7] ..... A01K 29/00; E01H 1/12

(52) U.S. Cl. ..... 294/1.4; 15/104.8; 15/257.3; 15/257.6; 15/257.8

(58) Field of Search ..... 294/1.3, 1.4, 19.2, 294/55; 15/104.8, 257.1, 257.3, 257.4, 257.5, 257.6, 257.7, 257.8

(56) References Cited

U.S. PATENT DOCUMENTS 1,349,582 A * 8/1920 Peterson ..... 15/104.8
3,453,676 A * 7/1969 Meszaros ..... 15/104.8
4,200,321 A 4/1980 Warkentin
4,316,627 A 2/1982 Solypa
4,741,566 A * 5/1988 Byung-Do et al. ..... 15/104.8
5,236,237 A * 8/1993 Shultz ..... 15/104.8
5,667,264 A 9/1997 Tanahara
5,671,959 A 9/1997 Tsou
6,113,166 A * 9/2000 Wynn ..... 15/104.8
6,135,520 A * 10/2000 Miller et al. ..... 294/1.4

FOREIGN PATENT DOCUMENTS

WO WO 93/06307 * 4/1993 ..... 294/1.4

* cited by examiner

*Primary Examiner*—Dean J. Kramer
(74) *Attorney, Agent, or Firm*—McHale & Slavin, P.A.

(57) ABSTRACT

An apparatus for the collection and disposal of waste material is provided. The apparatus includes a receptacle adapted to be placed on a support surface having a generally upright handle attached thereto. The receptacle includes a lower tray and a cooperating upper portion. The lower tray has substantially planar bottom wall, a pair of vertically extending side walls which include elongated lateral slots. The upper portion has a generally shell-like configuration, and includes a pair of vertically depending side walls which are slidable disposed between the vertically extending side walls of the lower tray. The upper portion has an arcuate front portion which has a front edge adapted to scrape a horizontal surface and a downwardly sloping rear portion adapted for flush alignment with the bottom wall of the lower tray. The upper portion is thus slidably and rotatably engaged with the lower tray so that the upper portion is operable to scrape materials from the support surface onto the lower tray so as to capture materials in the receptacle. A method for collecting materials from a support surface is also disclosed.

14 Claims, 7 Drawing Sheets

APPARATUS AND METHOD FOR THE COLLECTION AND DISPOSAL OF WASTE MATERIALS

FIELD OF THE INVENTION

This invention relates generally to the field of refuse collecting devices, and more specifically to a pickup device for the collection and disposal of waste materials.

BACKGROUND OF THE INVENTION

In the prior art, there are numerous devices and schemes for collecting waste materials without the need for direct user contact with the waste material. Many such devices are directed toward the removal of animal waste. In addition to this very obvious application, there are other more specialized instances requiring efficient removal of refuse from the floor or ground without physical contact. In the medical field, it is especially critical that medical wastes, such as syringes and items contaminated with bodily fluids, be collected and disposed in a sanitary manner. In an industrial environment, hazardous chemicals may be present, as well as potentially dangerous sharp objects like broken glass and scrap metal pieces.

Most prior art collection devices are designed to be used in conjunction with a second implement to sweep, push, scrape, or lift waste material into the receptacle. This requires the individual to use both hands. A distinct disadvantage of this arrangement is that it generally brings the individual into closer contact with the waste material than is desired. An example of an enclosed receptacle for receiving waste materials is seen in Barbaro, U.S. Pat. No. 6,032,995. Barbaro discloses a floor level locking compartment having an upright handle. The fact that the Barbaro device requires a second implement to place the waste material into the receptacle makes it unsuitable for medical applications since the second implement would become contaminated with the waste material.

In order to overcome the clear disadvantage of a needing a second implement, some devices demonstrate the use of a mechanically operated scoop or pushing implement which is integral to the device. Examples include Tanahara, U.S. Pat. No. 5,667,264, Warkentin, U.S. Pat. No. 4,200,321 and Tsou, U.S. Pat. No. 5,671,959. Each teaches the use of disposable bags or receptacles for the refuse. However, in each of these devices, the scoop or pushing implement directly contacts the waste material and would therefore become contaminated. Further, operation of the pushing implement in each of these devices is implemented by a mechanical linkage between the gripping handle and the pushing implement. These devices therefore have a number of mechanical parts which are prone to breakage or fouling. The mechanical parts also present difficult in maintaining the cleanliness of the apparatus.

A scoop-type implement, such as would be used in Solypa—U.S. Pat. No. 4,316,627, would be unsuitable for a smooth floor surface since a scooping action would only serve to push the waste material forward, and could result in spreading the material.

Thus, what is needed is a device for collecting and disposing of waste materials which is self-contained to allow for one-hand operation, and which provides a means to collect waste materials in a sanitary manner wherein the waste material does not contact the device itself.

SUMMARY OF THE INVENTION

It is an objective of the invention to provide a device for collecting waste material from a floor or ground surface which can be operated with one hand, and does not require additional pushing or sweeping implements.

It is another objective to provide a device for collecting waste material which has a minimal number of moving parts and can be inexpensively manufactured.

It is still another objective to provide a device for collecting waste material which can be used to collect, bag, transport and deposit wastes without contaminating the apparatus itself.

It is a further objective of the invention to provide a device for collecting waste material which can safely and efficiently collect and dispose of medical wastes such as hypodermic syringes, objects contaminated by bodily fluids and infectious materials.

It is yet a further objective of the invention to provide a device for collecting waste material which can safely and efficiently collect and dispose of sharp-edged objects such as broken glass and metal filings.

It is still a further objective of the invention to provide a device for collecting waste material which can safely and efficiently collect and dispose of objects which may be contaminated with hazardous chemicals.

In accordance with the above objectives, an apparatus for the collection of materials from a support surface is provided. The apparatus includes a receptacle adapted to be placed on a support surface which includes a lower tray and a cooperating upper portion. The lower tray has substantially planar bottom wall, a pair of vertically extending side walls. The front and back of the lower tray are substantially open. The vertically extending side walls respectively include elongated lateral slots extending therethrough. The upper portion has a generally convex configuration, and includes a pair of vertically depending side walls which are slidably disposed between said vertically extending side walls of the lower tray. The upper portion has an arcuate front portion which has a front edge adapted to scape a horizontal surface and a downwardly sloping rear portion adapted for flush alignment with the bottom wall of the lower tray. The side walls of the upper portion further include downwardly depending attachment lips.

The receptacle further includes an attachment means for securing the upper portion to the lower tray. The preferred attachment means are pivot members fixedly attached the attachment lips of the upper portion which extend through the elongated lateral slots of the lower tray. The upper portion is slidably and rotatably engaged with the lower tray, whereby the upper portion is operable to scrape materials from the support surface onto the lower tray so as to capture materials in said receptacle. The rear edge of the lower tray may include an outwardly extending foot placement tab so that the lower tray can be held in place by the foot of the user while materials are being collected.

The apparatus can include a generally upright handle attached to the upper portion to allow a user to rotate the upper portion with respect to said lower tray, and also to laterally translate said upper portion with respect to said lower tray. The apparatus can include a handle receptacle adapted to removably receive the handle so that the handle can be removed, if desired. The handle receptacle is preferably adapted to be manually gripped by a user so that the device can be operated without the handle.

The apparatus can include a sweeping implement downwardly depending from said front edge of said upper portion. The sweeping implement is preferably a bristled brush which is detachable from the receptacle. The sweeping implement can also be a plastic strip.

The apparatus can further include a handle grip affixed to the distal end of the handle which is adapted to store and dispense plastic bags. The handle grip can include an aperture through which plastic bags are dispensed.

The invention includes a method for collecting material from a support surface which includes the steps of placing the receptacle behind the material to be collected, rotating the front edge of the upper portion upward, sliding the upper portion forward relative to the lower tray until the front edge of the upper portion is a position beyond the material, rotating the front edge of the upper portion downward to contact the support surface and encompass the material within the upper portion, sliding the upper portion backward relative to the lower tray to drag the material onto the lower tray, rotating the upper portion backward until the rear edge of the upper portion is flushly aligned with the bottom wall of the lower tray, lifting the receptacle in a forward rotational motion until the lower tray is approximately 45° from the horizontal, transporting the receptacle to a deposit location; lifting the receptacle in a forward rotational motion until the lower tray rotates to a vertical position, and releasing the material into the deposit location. The method further includes the step of inserting a plastic bag into the receptacle, wherein materials to be collected are deposited in the plastic bag.

DETAILED DESCRIPTION OF THE INVENTION

Figure 1:
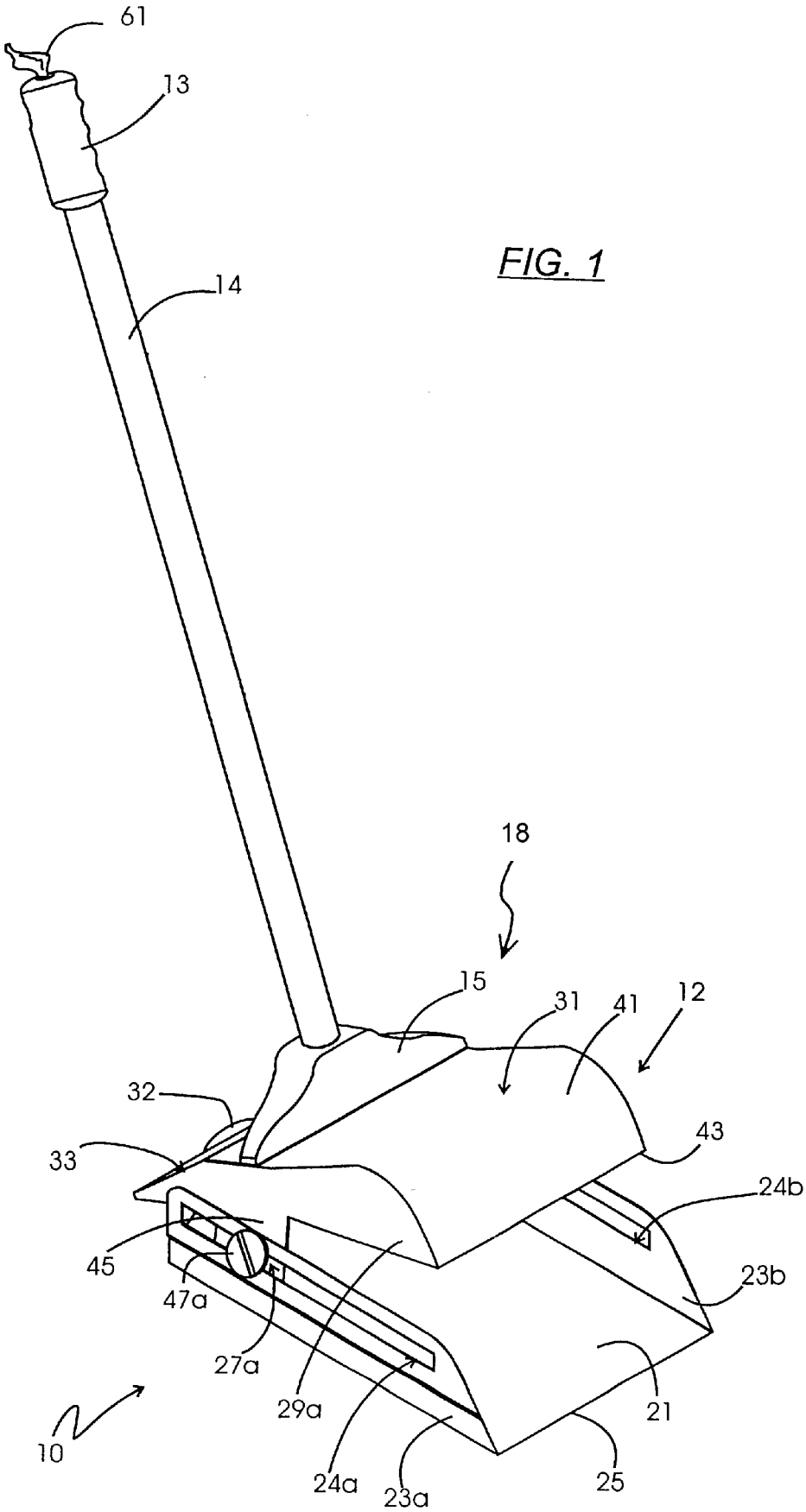
FIG. 1 illustrates a perspective view, taken from the front and right, of the apparatus for a waste collection according to a preferred embodiment of the invention, in which the receptacle is shown in an open position.
Figure 2:
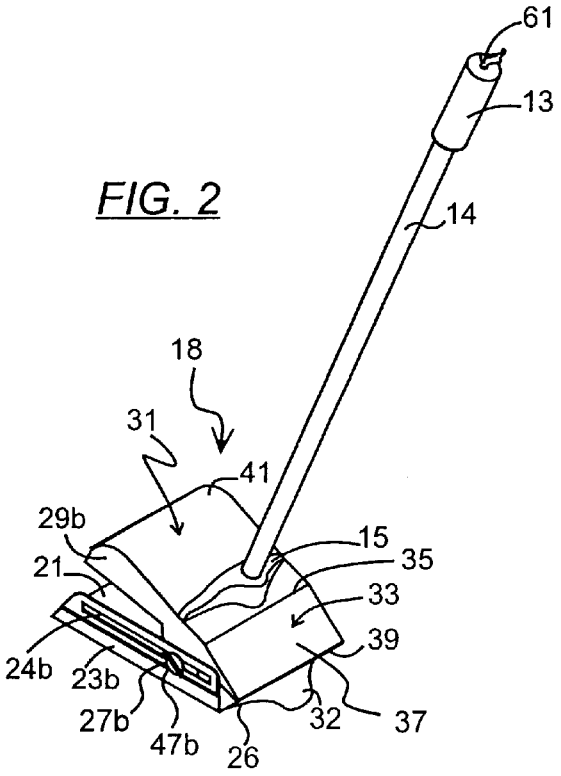
FIG. 2 is a perspective view of the apparatus shown in FIG. 1, taken from the rear and left.
Figure 6:
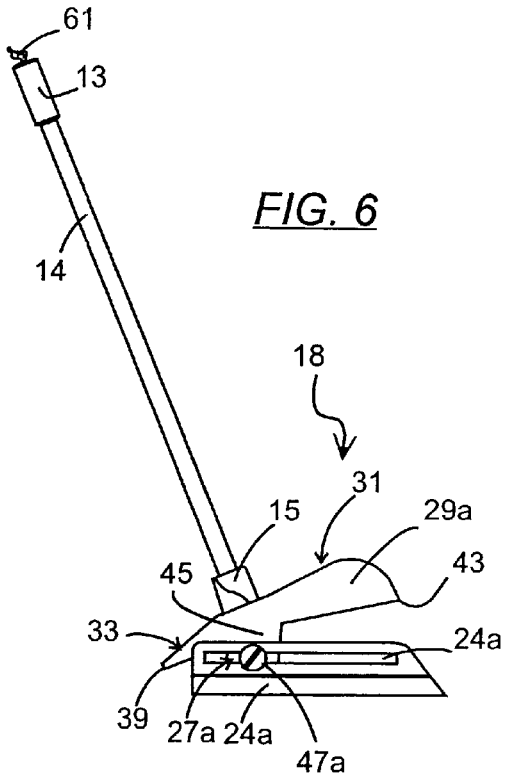
FIG. 6 is right side view of the apparatus shown in FIG. 1.
Figure 3:
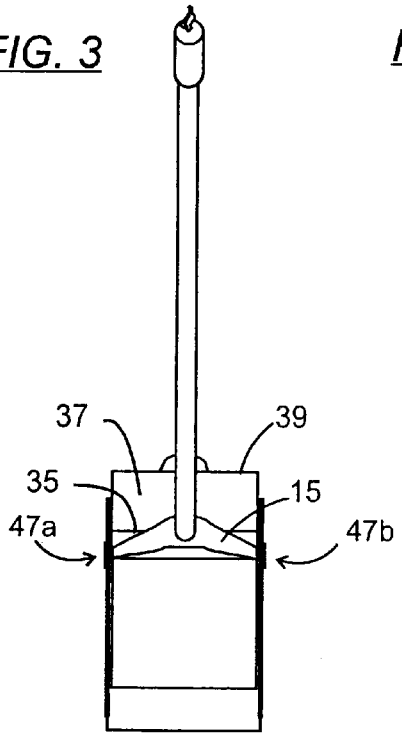
FIG. 3 is top plan view of the apparatus shown in FIG. 1.
Figure 4:
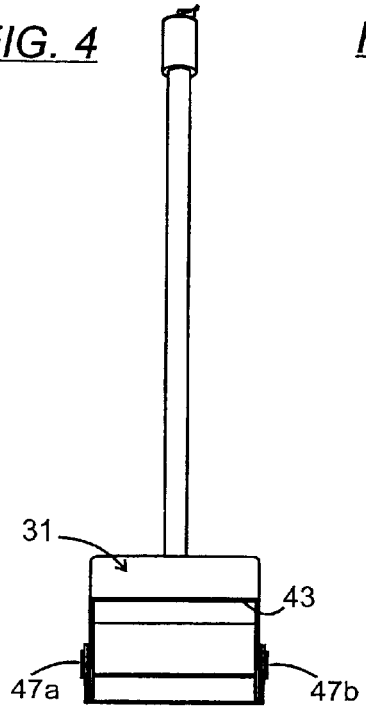
FIG. 4 is front view of the apparatus shown in FIG. 1.
Figure 5:
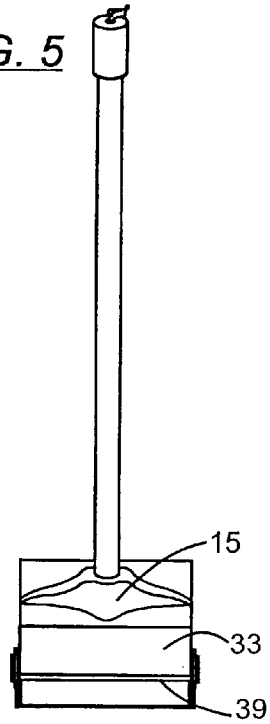
FIG. 5 is rear view of the apparatus shown in FIG. 1.

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

An apparatus 10 for collecting and disposing of waste materials according to a preferred embodiment of the invention is shown in FIGS. 1–6. The apparatus 10 includes a receptacle 12 adapted to be placed on a support surface and a generally upright handle 14. The handle 14 is removable from the receptacle 12, and is positionable in a handle receptacle 15. The receptacle 12 includes a lower tray 16 and a cooperating upper portion 18. The lower tray 16 has substantially planar bottom wall 21 and a pair of vertically extending left and right side walls 23*a* and 23*b*. The front and back of the lower tray 16 are generally open, and terminate in front and rear edges 25 and 26. The rear edge can include a planar foot placement tab 32 which extends outwardly from rear edge 26. The left and right side walls 23*a* and 23*b* respectively include elongated lateral slots 24*a* and 24*b*.

The upper portion 18 has a generally shell-like configuration and is dimensioned to be slidably disposed between left and right side walls 23*a* and 23*b* which are preferably flushly aligned with the left and right side walls 23*a,b* of the lower tray. The upper portion 18 includes opposing vertically oriented side walls 29*a* and 29*b*. The width of upper portion 18 is dimensioned to be closely aligned with left and right side walls 23*a* and 23*b* while still allowing upper portion 18 to slide freely within the lower tray 16. The length of upper portion 18 is preferably approximately equal to the distance between front and rear edges 25 and 26. The upper portion 18 includes a front portion 31 and a rear portion 33 which can be generally defined by a line of intersection 35.

The rear portion 33 includes a top surface 37 which preferably slopes downwardly from the line of intersection 35 to a rear edge 39 which is perpendicular to side walls 29*a,b*. The front portion 31 has a generally scoop-like shape and includes an arcuate top surface 41 which terminates in a front edge 43.

Figure 7A:
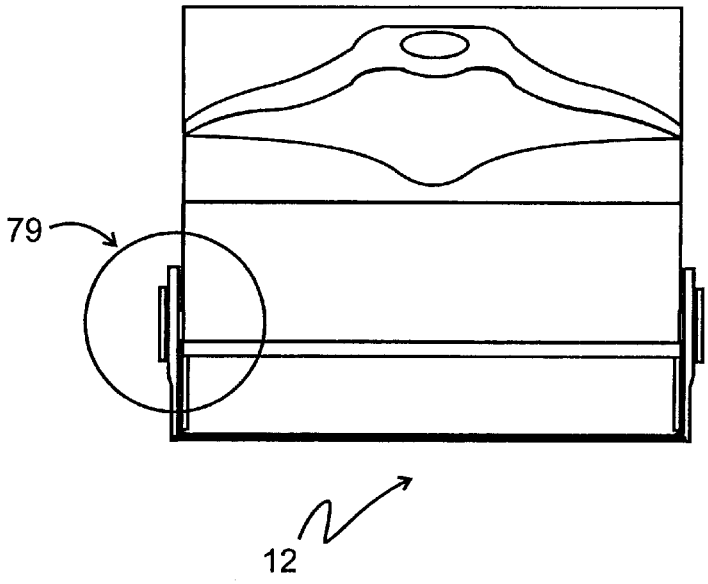
FIGS. 7A and 7B illustrate the detail of the right side pivot member of the apparatus shown in FIG. 1.
Figure 7B:
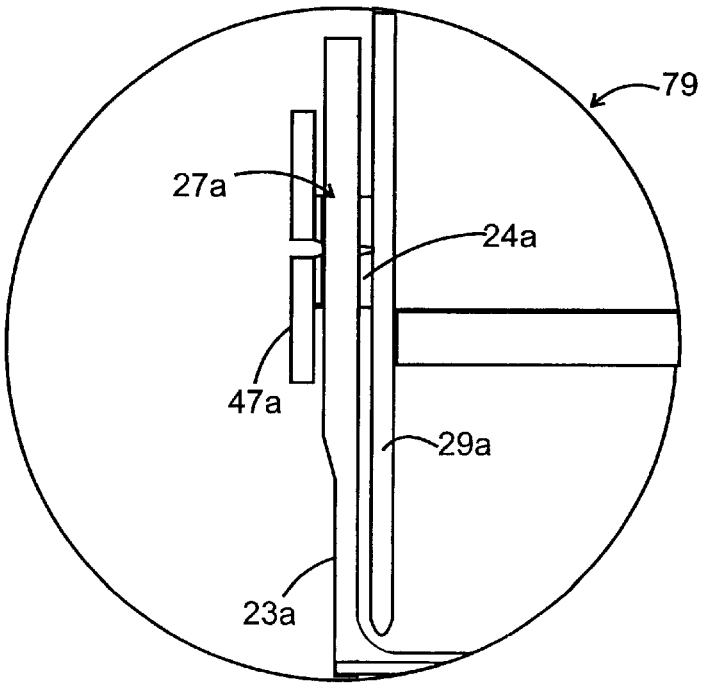

The side walls 29*a,b* of the upper portion 18 preferably each include downwardly extending attachment lips 45. The upper portion 18 is fixedly attached to lower tray 16 by means of pivot members 27*a,b* which are preferably fixedly attached to attachment lips 45*a,b*. FIGS. 7A and 7B illustrates in detail the attachment of the upper portion 18 to lower tray 16. The pivot members 27*a,b* respectively extend through the lateral slots 24*a* and 24*b* and can be secured by pivot heads 47*a,b*. The pivot members 27*a,b* can be integrally formed with upper portion 18 or can be otherwise attached to the upper portion 18 using any suitable attachment means.

The pivot members 27*a,b* preferably allow rotational motion of the upper portion 18 with respect to the lower tray 16. The pivot members 27*a,b* can also laterally translate through the elongated slots 24*a,b* so that upper portion 18 can slide along the length of lower tray 16. When the front portion 31 of upper portion 18 is fully rotated upwards, the rear edge 33 of upper portion 18 is preferably flushly aligned with the bottom wall 21 of lower tray 16. When the front portion 18 is rotated fully downwards, the front edge 43 is flushly aligned with either the bottom wall 21, or if the upper portion 18 is slid forward a sufficient distance with respect to lower tray 16, with an underlying floor or ground surface. As will be discussed in detail hereinafter, the upper portion 18 is functional to pull or drag materials from the floor or ground surface into the receptacle 12. To accomplish this, the placement of the elongated slots 24*a,b* and the configuration of the upper portion 18 cooperate to allow the front edge 43 to be rotated to a sufficient height to fully encompass the materials to be collected.

Figure 8:
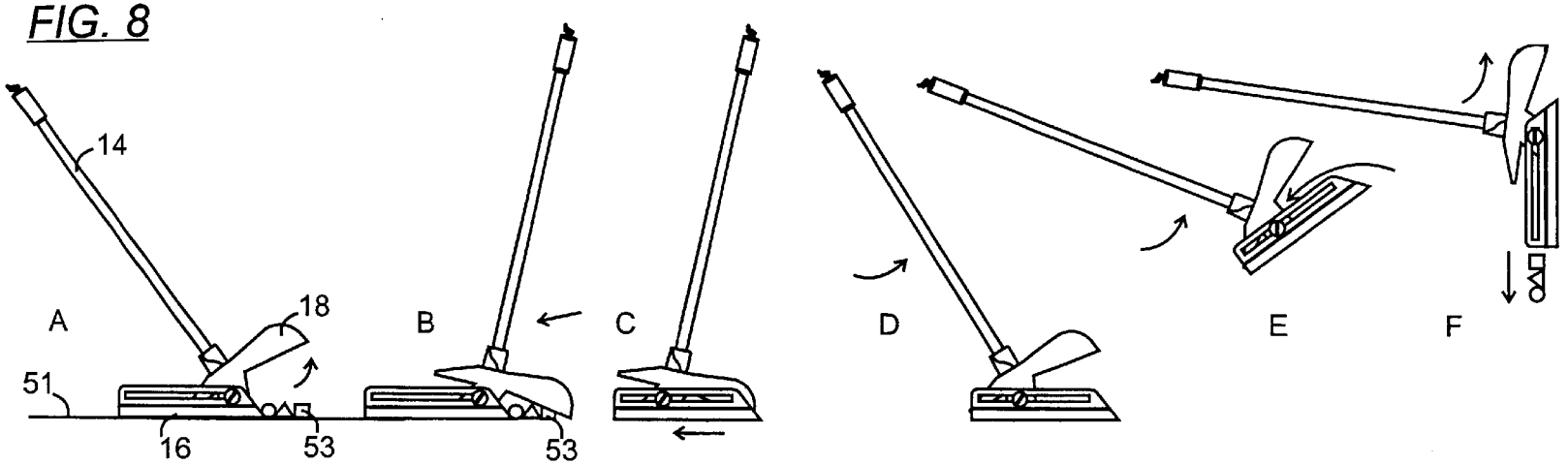
FIGS. 8A–F illustrate the sequential steps of a preferred mode of operation of the waste collection apparatus according to a preferred embodiment of the invention.

A preferred mode of operation of the apparatus 10 is sequentially illustrated in FIGS. 8A–F. The apparatus 10 is positioned so that the lower tray 16 rests on a ground or floor surface 51 and positioned proximal to material to be collected, represented in the illustration as objects 53. The lower tray can be secured in place by the user by placing the user's foot on the tab 32. The user manipulates the handle 14 to push the upper portion 18 forward with respect to lower tray 16. In the same motion, the handle 14 can be tilted to a backward position (counterclockwise in the illustration) in order to rotate the front portion 31 of upper portion 18 to a raised position (FIG. 8A). The handle 14 can then be rotated in a forward direction (clockwise in the illustration) so that the upper portion 18 covers the objects 53 (FIG. 8B). The front edge 43 is preferably flushly aligned with the floor or ground surface 51. While maintained this flush alignment, the handle is urged rearwardly by the user without rotational motion so as to drag the objects 53 int the receptacle 12.

At this point, the apparatus 10 is then lifted from the floor or ground surface 51 so that the objects 53 can be deposited in a suitable location, such as a refuse container. The handle 14 is rotated backwardly (counterclockwise as shown) until the rear edge 26 abuts the bottom wall 21 (FIG. 8D). The receptacle 10 is then manually lifted from the ground in a circular motion motion until the lower tray is at a position of approximately 45° from the horizontal. (FIG. 8E). In this position, the bottom wall 21 of the lower tray 16 is then biased against the rear edge 26 of upper tray 18 so that the objects 53 are maintained in the receptacle 12. The apparatus 10 can be then carried with the objects 53 secured inside to a desired location. To release the objects 53, the handle 14 is rotated to a position of approximate 90° from the vertical position. This motion causes the lower tray 14 to rotate and fall downward along the elongated slots 24*a,b* to a vertical position, allowing the objects 53 to fall out (FIG. 8F). In use, the apparatus 10 would typically be carried to a refuse container to release the objects 53.

Figure 9:
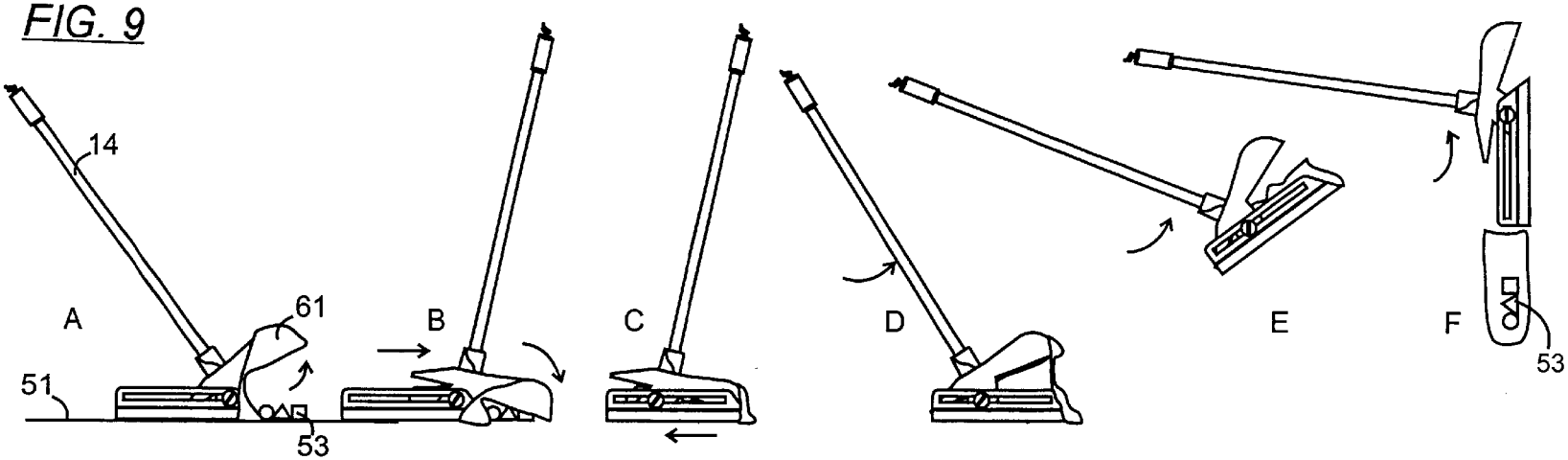
FIGS. 9A–F illustrate the sequential steps of the preferred mode of operation of the apparatus utilizing disposable plastic bags.

For sanitary operation, the apparatus 10 can also be used with disposable plastic bags as illustrated in FIGS. 9A–F. The plastic bag 61 is initially fitted inside the receptacle 10 so as to cover the upper portion 18 and the lower tray 16. The edges of the plastic bag 61 can be folded around the outer edges of the upper portion 18 and the lower tray 16 to hold the plastic bag 61 in place. The steps illustrated in FIGS. 9A–C are then repeated to drag the objects 53 into plastic bag 61 located in the receptacle 12. Using the handle 14, the user can manipulate the upper portion 18 to release it from the plastic bag 61. In step 9E, the apparatus 10 is lifted in a rotation motional so that the handle 14 is approximately 30 degrees from the vertical. The plastic bag 61, with the objects 53 contained therein, is then secured within the receptacle 12. If desired, the apparatus 10 can then be transported by the user to a desired location to deposit the plastic bag 61 and its contents. As in step 9F, the handle 14 is rotated to a position of approximate 90 degrees from the vertical position to release its contents. The lower tray 16 then rotates and fails downward along the elongated slots 24*a,b* to a vertical position and the plastic bag 61 is released with its objects 53 intact inside the bag. The user can then manually seal the bag, if desired.

In the preferred embodiment, a handle grip 13 affixed to the handle 14 can also serve as a storage container for plastic bags 61 to be used with the apparatus 10. This is most clearly seen in FIGS. 1–6. The plastic bags are can be dispensed from an aperture located at the top of the grip 13. Any suitable means can be incorporated into the apparatus 10 to dispense plastic bags, and the invention is not limited in this regard.

Figure 10:
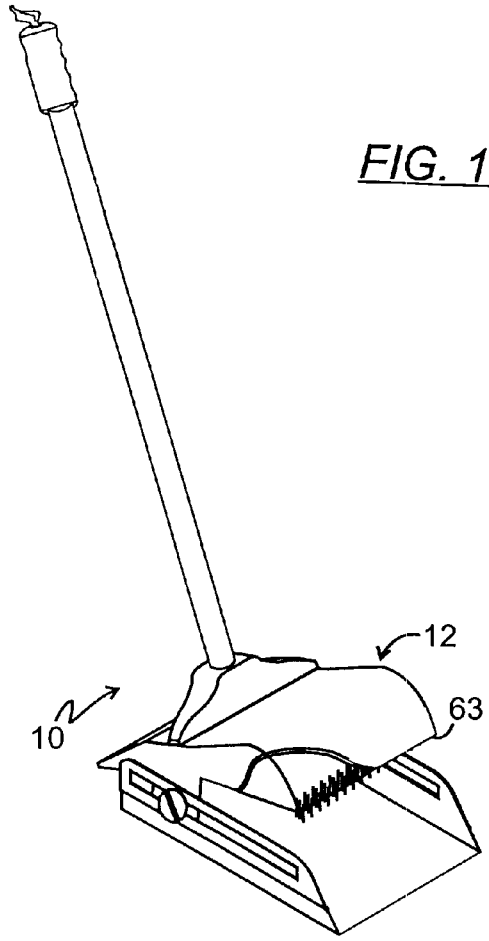
FIG. 10 illustrates a sweeping implement affixed to the waste collection apparatus according to a the preferred embodiment.
Figure 11:
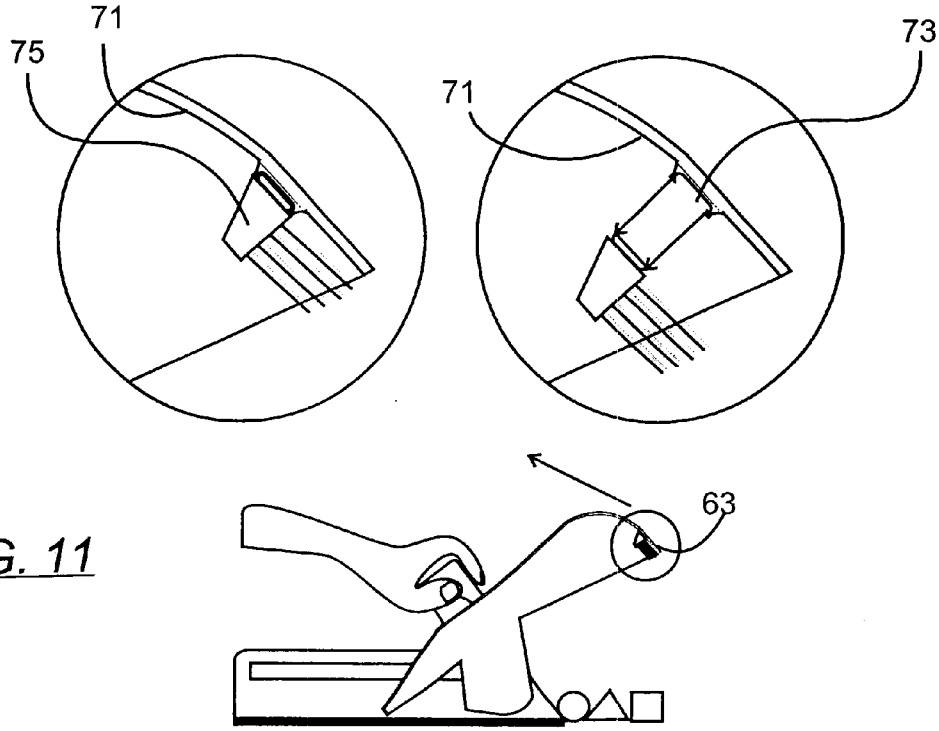
FIG. 11 illustrates a preferred means of attachment of the sweeping implement to the apparatus.

As seen in FIG. 10, the front edge 43 of upper portion 18 can also include a sweeping implement 63 which extends downwardly from the front edge 43 to facilitate the collection of materials. The sweeping implement 63 is illustrated as a bristled brush, however the sweeping implement 63 can be any suitable structure which is functional to sweep or scrape materials into the receptacle 12. The sweeping implement 63 can also be a strip of pliable plastic. FIG. 11 illustrates a preferred means of affixing the sweeping implement to the upper portion 18. The inside surface 71 of the upper portion 18 can include an integrally formed groove 73 parallel to the front edge 43. The groove 73 is dimensioned for mated engagement with the attachment portion 75 of the sweeping implement 63. The sweeping implement 63 is preferably removable from the upper portion 18 for cleaning or replacement purposes.

Figure 12:
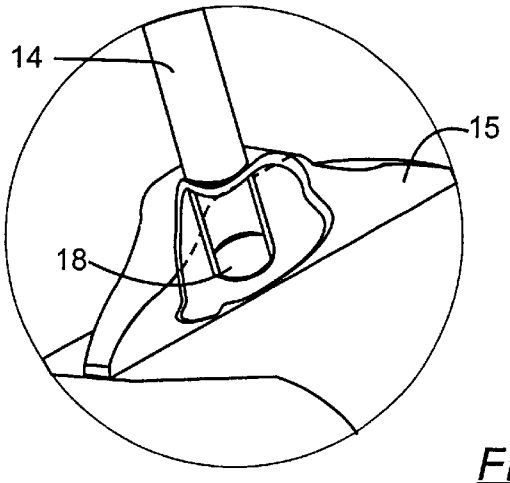
FIG. 12 illustrates a cutaway view of the handle receptacle of the present invention showing the placement of the handle therein.
Figure 13B:
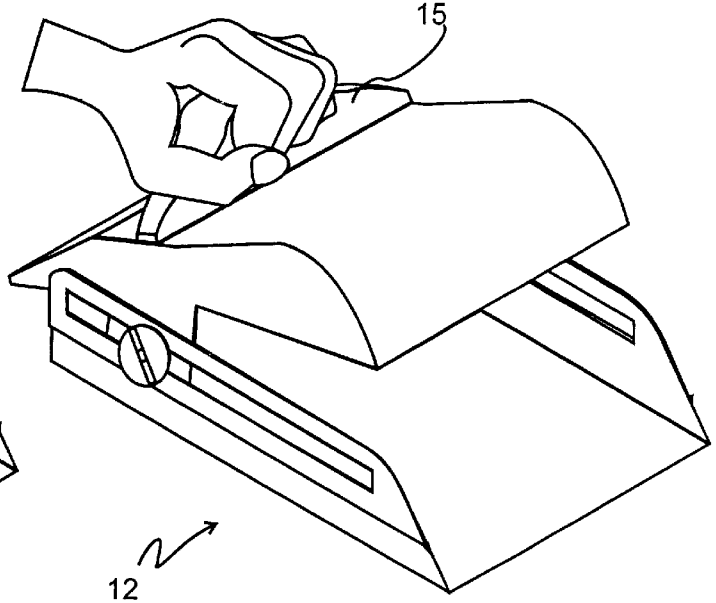
FIGS. 13A and 13B illustrate the manual operation of the apparatus with the handle removed from the handle receptacle.
Figure 13A:
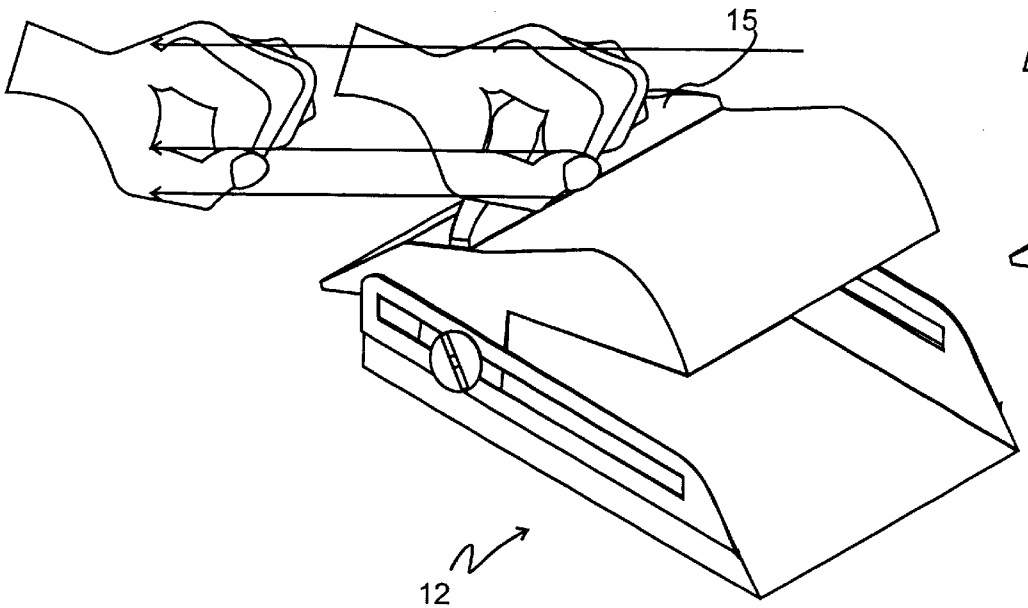
Figure 14:
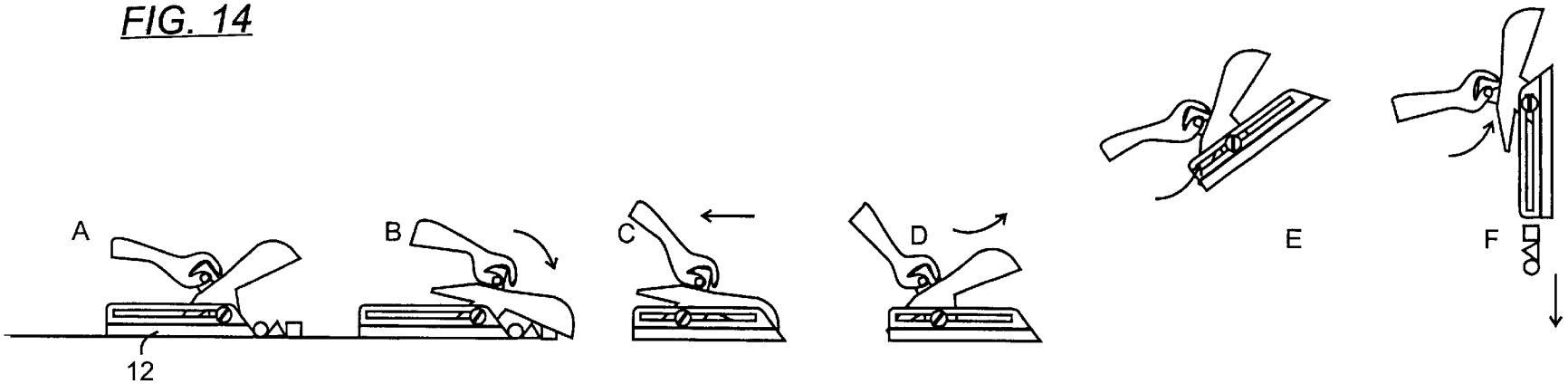
FIGS. 14A–F illustrate the sequential steps of the preferred mode of operation in which the handle is removed from the handle receptacle.
Figure 15:
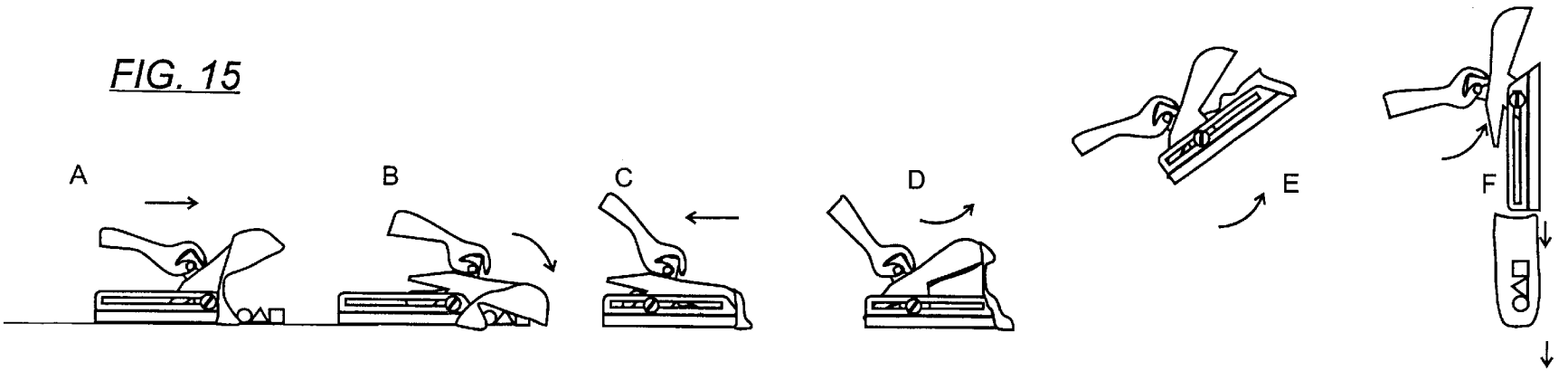
FIGS. 15A–F illustrate the sequential steps of the preferred mode of operation utilizing disposable plastic bags in which the handle is removed from the handle receptacle.

In the preferred embodiment, the handle 14 is removable from the handle receptacle 15 for cleaning and storage purposes, as well as for an alternative mode of operation to be described hereinafter. As shown in the cutaway view shown in FIG. 12, the handle receptacle includes a cavity 81 adapted to slidably receive the handle 14. The cavity 81 is preferably dimensioned for close engagement with the handle 14. FIGS. 13A and 13B illustrate the operation of the apparatus 10 without the handle 14 inserted into the handle receptacle 15. The handle receptacle 15 is preferably configured to allow a user to manually grip the handle receptacle 15 and operate the apparatus in the manner previously described. The sequential steps for this mode of operation are illustrated in FIGS. 14A–F (without plastic bags inserted) and 15A–F (with plastic bags). This mode of operation is particular useful for collecting waste materials from a table top or other elevated work surface.

The relative dimensions for components of the apparatus 10 as depicted in the figures are for illustrative purposes only, and the dimensions of the receptacle 12 with respect to the handle 14 can vary depending on the desired application for the apparatus 10. If the approximate size of the objects to be collected is known, the size of the receptacle 12 can be varied accordingly. For example, if the apparatus 10 is the be used to collect hypodermic syringes, the receptacle 12 can be scaled to the appropriate dimensions to contain a hypodermic syringe.

The apparatus 10 can be constructed from a suitable materials, such as plastic or metal, or a combination thereof. Injection-molded plastic is a suitable material for applications in which it is desired that the apparatus 10 be lightweight and inexpensively manufactured. Metal components, such as the pivots and the pivot heads, can be used in combination with plastic components. Plastic can also be used for applications where the apparatus 10 (or only the receptacle 12) is intended to be disposable. For industrial applications, it may be desired to construct at least some of the components of the apparatus 10 from metal to provide the necessary sturdiness.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

I claim:

1. An apparatus for the collection and disposal of waste materials; comprising:

a receptacle adapted to be placed on a support surface, said receptacle including a lower tray and a cooperating upper portion; said lower tray having a substantially planar bottom wall; a pair of vertically extending side walls and front and rear edges wherein the front and back of said lower tray are substantially open; said vertically extending side walls respectively including elongated lateral slots extending therethrough; said upper portion having a generally convex configuration; said upper portion further including a pair of vertically depending side walls which are slidably disposed between said vertically extending side walls of said lower tray; said upper portion having an arcuate front portion having a front edge adapted to scrape a horizontal surface and a downwardly sloping rear portion terminating in a rear edge, said rear edge adapted for flush alignment with said bottom wall of said lower tray; said vertically depending side walls of said upper portion further including downwardly depending attachment lips;

said receptacle further including an attachment means for securing said upper portion to said lower tray; said attachment means comprising pivot members fixedly attached to said attachment lips; said pivot members extending through said elongated lateral slots wherein said upper portion is slidably and rotatably engaged with said lower tray, whereby said upper portion is operable to scrape materials from a support surface onto said lower tray to capture materials in said receptacle.

2. The apparatus according to claim 1, further including a generally upright handle attached to said upper portion, wherein a user can operate said handle to rotate said upper portion with respect to said lower tray.

3. The apparatus according to claim 2, further including a generally upright handle attached to said upper portion, wherein a user can operate said handle to laterally translate said upper portion with respect to said lower tray.

4. The apparatus of claim 2, wherein said upper portion includes a handle receptacle adapted to removably receive said handle.

5. The apparatus of claim 4, wherein said handle receptacle is adapted to be manually gripped by a user.

6. The apparatus of claim 2, further comprising a handle grip affixed to the distal end of the handle, wherein said handle grip is adapted to store and dispense plastic bags, said handle grip further including and aperture through which plastic bags are dispensed.

7. The apparatus of claim 1, further comprising a sweeping implement downwardly depending from said front edge of said upper portion.

8. The apparatus of claim 7, wherein said sweeping implement is a bristled brush.

9. The apparatus of claim 7, wherein said sweeping implement is a plastic strip.

10. The apparatus of claim 1, further said rear edge of said lower tray includes an outwardly extending foot placement tab, wherein the lower tray can be held in place by the foot of the user.

11. A method for collecting materials from a surface, comprising:

providing a receptacle adapted to be placed on a support surface, the receptacle including a lower tray and a cooperating upper portion; the lower tray having a substantially planar bottom wall; a pair of vertically extending side walls and front and rear edges wherein the front and back of said lower tray are substantially open; the vertically extending side walls respectively including elongated lateral slots extending therethrough; the upper portion having a generally convex configuration; the upper portion further including a pair of vertically depending side walls which are slidably disposed between the vertically extending side walls of said lower tray; the upper portion having an arcuate front portion having a front edge adapted to scrape a horizontal surface and a downwardly sloping rear portion terminating in a rear edge, said rear edge adapted for flush alignment with the bottom wall of said lower tray; the vertically depending side walls of the upper portion further including downwardly depending attachment lips; the receptacle further including pivot members fixedly attached to the attachment lips and extending through the elongated lateral slots, wherein said upper portion is slidably and rotatably engaged with said lower tray;

placing the receptacle behind the material to be collected;

rotating the front edge of the upper portion upward;

sliding the upper portion forward relative to the lower tray until the front edge of the upper portion is a position beyond the material;

rotating the front edge of the upper portion downward to contact the support surface and encompass the material within the upper portion;

sliding the upper portion backward relative to the lower tray to drag the material onto the lower tray;

rotating the upper portion backward until the rear edge of the upper portion is flushly aligned with the bottom wall of the lower tray;

lifting the receptacle in a forward rotational motion until the lower tray is approximately 45° from the horizontal;

transporting the receptacle to a deposit location;

lifting the receptacle in a forward rotational motion until the lower tray rotates to a vertical position; and releasing the material into the deposit location.

12. The method according to claim 11, wherein said receptacle further comprises a generally upright handle attached to said upper portion.

13. The method according to claim 11, further comprising the step of inserting a plastic bag into said receptacle, wherein materials to be collected are deposited in the plastic bag.

14. The method according to claim 11, wherein said receptacle further comprises a sweeping implement attached to the front edge of the upper portion.

* * * * *